US008230597B2

(12) United States Patent
Szuba et al.

(10) Patent No.: US 8,230,597 B2
(45) Date of Patent: Jul. 31, 2012

(54) FORMING PREFORMS AND PARTS THEREFROM

(75) Inventors: Joseph Szuba, Dearborn, MI (US); Rodney G. Whitbeck, Northville, MI (US); Keith Hughes, Milford, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 868 days.

(21) Appl. No.: 12/245,049

(22) Filed: Oct. 3, 2008

(65) Prior Publication Data

US 2010/0083783 A1 Apr. 8, 2010

(51) Int. Cl.
*B21C 1/24* (2006.01)
*B21D 3/00* (2006.01)
*B21D 53/28* (2006.01)

(52) U.S. Cl. ..... 29/893; 29/893.32; 29/417

(58) Field of Classification Search ..... 29/417, 29/893, 893.32, 893.34–893.36; 72/83, 254, 72/283, 354.6, 367.1; 74/468
See application file for complete search history.

(56) References Cited

U.S. PATENT DOCUMENTS

| | | | | |
|---|---|---|---|---|
| 4,692,071 | A | 9/1987 | Hirota | |
| 4,770,572 | A | 9/1988 | Ohkawa et al. | |
| 4,772,368 | A | 9/1988 | Rabian | |
| 5,384,949 | A * | 1/1995 | Wodrich et al. | 29/557 |
| 5,465,597 | A | 11/1995 | Bajraszewski et al. | |
| 5,538,369 | A | 7/1996 | Okuda | |
| 5,551,270 | A | 9/1996 | Bajraszewski et al. | |
| 6,204,466 | B1 | 3/2001 | Tabor | |
| 6,907,764 | B2 * | 6/2005 | Ushida | 72/327 |
| 2010/0083782 | A1 * | 4/2010 | Cheisa et al. | 74/458 |

* cited by examiner

*Primary Examiner* — Alexander P Taousakis
(74) *Attorney, Agent, or Firm* — Raymond Coppiellie, Esq.; MacMillan, Sobanski & Todd, LLC

(57) ABSTRACT

A method for forming a component includes forming a workpiece into a hollow preform cylinder concentric with an axis and including an inner surface that extends along the axis, placing within the preform cylinder a mandrel having an outer surface, flow-forming the inner surface and the outer surface of the preform cylinder such that the inner surface of the cylinder conforms to at least a portion of the outer surface of the mandrel, and cutting the flow formed cylinder transversely with respect to the axis into segments, each segment having an axial length.

17 Claims, 8 Drawing Sheets

FORMING PREFORMS AND PARTS THEREFROM

BACKGROUND OF THE INVENTION

1. Field of the Invention

This invention relates generally to metal forming and, in particular, to producing an extrusion preform from flat stock. Gear teeth and a cam surface may be formed by a cold extrusion process or by flow forming.

2. Description of the Prior Art

Cold extrusion of precision components, such as a helical ring gear, other gear forms, or a race having an inclined ramp for a one-way clutch, requires the use of preforms or blanks produced to tight tolerances. The current accepted practice involves producing the initial working stock by drawing a steel billet at high temperature over a cylindrical mandrel into a rough cylindrical shape, a process called "drawn over mandrel" (DOM). The stock, so formed, is then cut transversely into longitudinal sections, which are finish machined to tight dimensional tolerances.

The process is costly, requires high energy input, and results waste of raw material because considerable machining is required to produce dimensionally acceptable preforms.

Precision machining of a race for a one-way clutch of the type used in an automatic transmission requires several operations including machining a preform from a tube, cutting lobes with a broach tool, finish machining and final deburring.

Broach bars are expensive, require sulfonated broaching oils, need frequent sharpening and are slow relative to other machining or forming methods. Removal of oil from chips is costly and results in housekeeping concerns such as storing, transporting and disposal of chips and safety issues involved with oily surfaces. The oil is very expensive and must be filtered to remove fine metal particles before its reuse.

A need exists in the metal forming industry for a method to produce formed blanks and components. The blanks should be formed close to or fully net shape, thereby producing very little waste using conventional forming equipment normally available to manufacturing companies capable of extruding helical gears or similar products.

Preferably, the method would eliminate the need for custom processing at a steel supplier, and the preforms or blanks would be produced from flat plate or roll stock at a gear extrusion supplier.

SUMMARY OF THE INVENTION

A method for forming a component includes forming a workpiece into a hollow preform cylinder concentric with an axis and including an inner surface that extends along the axis, placing within the preform cylinder a mandrel having an outer surface, flow-forming the inner surface and the outer surface of the preform cylinder such that the inner surface of the cylinder conforms to at least a portion of the outer surface of the mandrel, and cutting the cylindrical formed cylinder transversely with respect to the axis into segments, each segment having an axial length.

Preforms or blanks, produced from low cost flat plate or coil stock eliminate need for custom processing at a steel supplier.

Preforms are produced with conventional forming equipment normally available to manufacturing companies capable of performing cold forming, spinning, swaging, hammer forming of cylindrical products. The forming blanks are close to or fully net shape, producing very little waste. The producer can greatly reduce lead time to obtain blanks compared to the DOM process from steel supplier. The producer can control quantity, inventory and quality of incoming raw material to the cam forming process.

No machining is required on the finished clutch race cam ramps. No lubricating fluid is needed, and tooling cost is lower than costs for broach tooling.

The scope of applicability of the preferred embodiment will become apparent from the following detailed description, claims and drawings. It should be understood, that the description and specific examples, although indicating preferred embodiments of the invention, are given by way of illustration only. Various changes and modifications to the described embodiments and examples will become apparent to those skilled in the art.

DESCRIPTION OF THE DRAWINGS

The invention will be more readily understood by reference to the following description, taken with the accompanying drawings, in which.

DESCRIPTION OF THE PREFERRED EMBODIMENT

Figure 1:
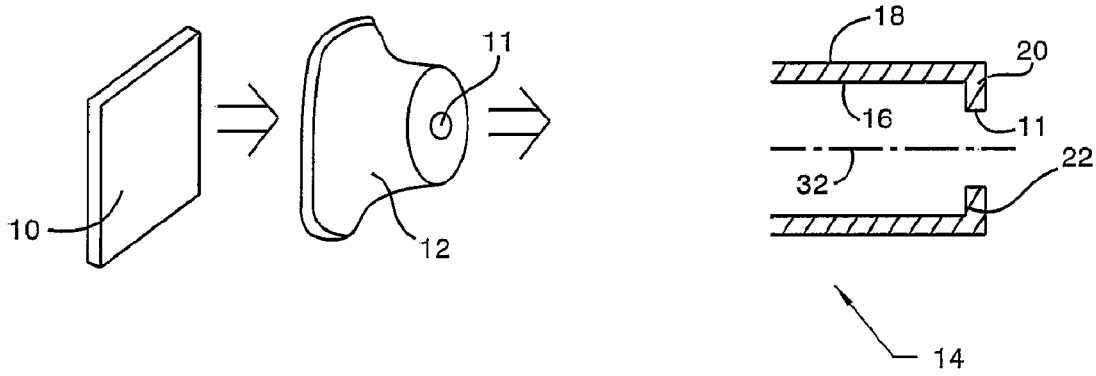
FIG. 1 is a schematic diagram showing a series of process steps for making a perform cylinder.

Referring now to the drawings, FIG. 1 illustrates a workpiece 10, preferably a plate or coiled sheet of carbon steel, which is formed with a central hole 11 into an elongated cup shape 12 by a conventional cold or hot forging or drawing method. After the cupped preform 12 is annealed to soften the material, make it less brittle and relieve internal stresses, the cup shaped preform 12 is processed by various techniques including a flow forming operation to produce a net shape preform 14 having an inner surface 16, an outer surface 18 and an end 20 that is partially closed by a radial flange 22.

Figure 2:
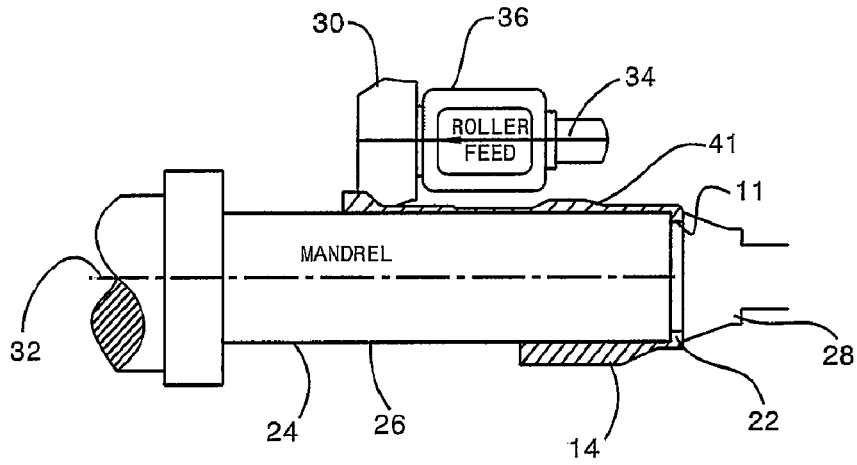
FIG. 2 is side view of the contour of the preform of FIG. 1 being formed by flow forming.

The flow forming procedure illustrated in FIG. 2 employs a mandrel 24 having an exterior surface 26. The net shape preform 14 is fitted over the mandrel and secured at its end 20 by a tailstock 28 that clamps flange 22 to the end of the mandrel. Several rollers 30, mutually spaced angularly about axis 32, are forced into contact with the outer surface of preform 14. Each roller 30 rotates about a respective axis 34 and translates leftward along axis 32.

The outer surface 18 of preform 14 is flow formed into a cylinder 40 by contact pressure between preform 14 and the rollers 30 and movement of the rollers over the mandrel 24 and preform. The inner surface 16 of preform 14 is flow formed due to contact pressure between preform 14 and the outer surface of the mandrel 24. The material of the cylindrical wall of the preform 14 flows axially and radially with respect to axis 32, as the rollers 30 and roller feed 36 move as a unit along axis 32 and angularly and radially with respect to the axis.

Figure 3:
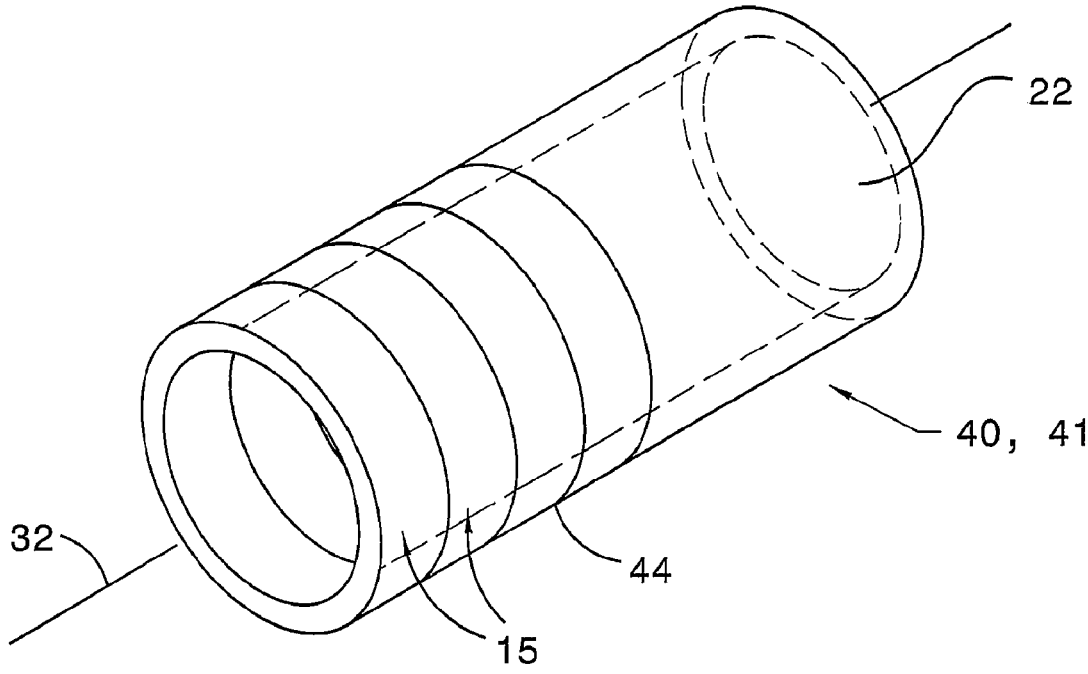
FIG. 3 is a perspective view of a circular cylinder having been cold formed from the cupped preform of FIG. 1.

The preform 14 may be flow formed in this way such that its outer and inner surfaces are those of a long circular cylinder 40, as shown in FIG. 3. An axial end of cylinder 40 may be formed with a flange 11, 52, as shown in FIGS. 1, 5A-5D and 6.

Alternately, the outer surface 18 of preform 14 is not a uniform circular cylinder but instead is a cylinder 41 formed with exterior features, such as changes in its wall thickness due to the material of the cylindrical wall of the preform flowing axially and radially with respect to axis 32 as the rollers 30 move both axially about axis 32 and radially with respect to axis 32, as FIG. 2 shows above the axis 32.

Similarly, the outer surface 26 of the mandrel 24 may be other than a circular cylinder. For example, the outer surface 26 of the mandrel 24 may be formed with helical gear teeth extending along at least a portion of the length the length of the mandrel, or the outer surface of the mandrel 24 may be formed with cam ramps for the outer race of a one-way clutch, the cam ramps being arranged about axis 32 and extending along at least a portion of the length of the mandrel. In these instances, the inner surface 16 of the perform cylinder 14 will be flow formed either with helical gear teeth or cam ramps.

Figure 4:
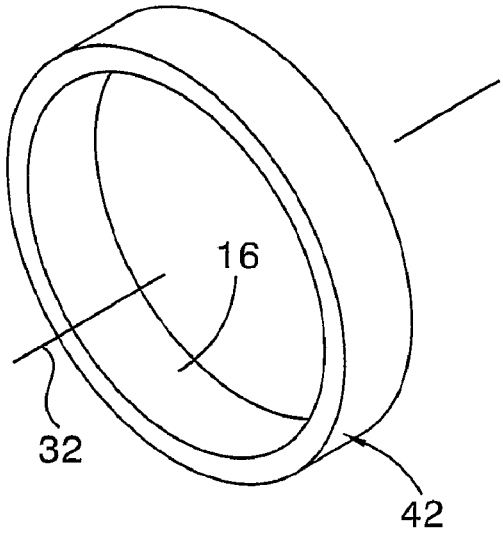
FIG. 4 is a perspective view of a cylindrical blank cut from the cylinder of FIG. 3.

As FIG. 4 illustrates, the flow formed cylinder 40, 41 is then cut transversely with respect to axis 32 into multiple ring segments or blanks 42 by any of several techniques including laser cutting. Preferably, cylinder 40, 41 is cut into segments 42 by a concentrated jet of water at high pressurize, preferably containing garnet, directed from a nozzle 44 onto the rotating cylinder at axially spaced locations. The segments 42 are thereafter finish machined, thermally processed and coated.

An alternate process for forming a preform cylinder, called in-die forming, is described with reference to FIGS. 5A-5D. A circular plate or sheet 50 having a central pilot hole 52, preferably of very low-carbon steel, is stamped with a diameter of about 1.0 inch. Plate 50 has an upper surface 54 and a lower surface 56. If plate 50 is of high carbon steel, it is annealed before executing the progressive forming stages.

Plate 50 is placed over a solid die 58 centered about axis 32. Die 58 includes a shoulder 62 having an internal radius 64, and a body 66 having an outer surface 68. A draw ring 70 contacting the upper surface 54 of plate 50 is forced by a hydraulic press (not shown) downward in several progressive stages causing the plate to conform to the surface of shoulder 62, radius 64 and surface 68.

Figure 5A:
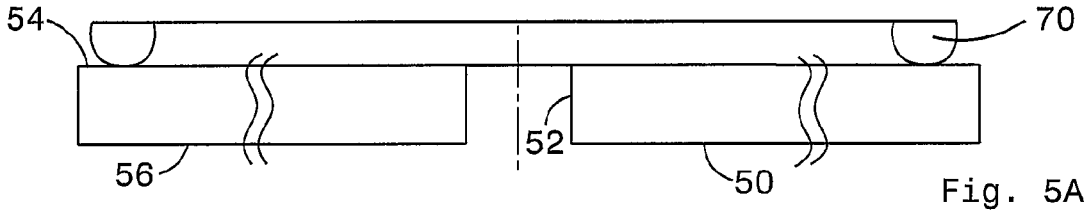
FIGS. 5A-5D are cross sections illustrating steps in the process of cold forming a ring gear and clutch race from a flat plate using a die and mandrel.
Figure 5B:
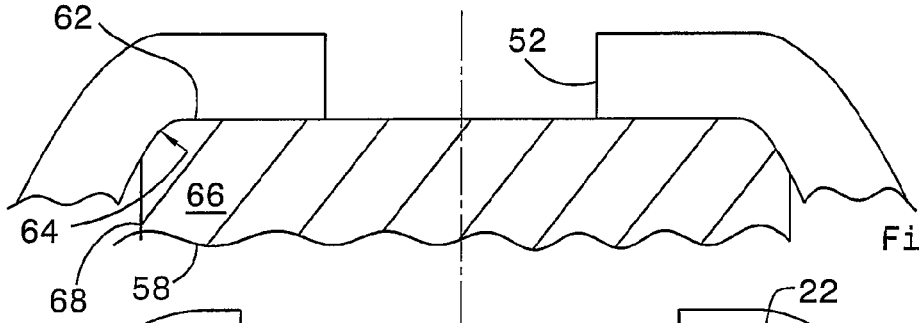
Figure 5C:
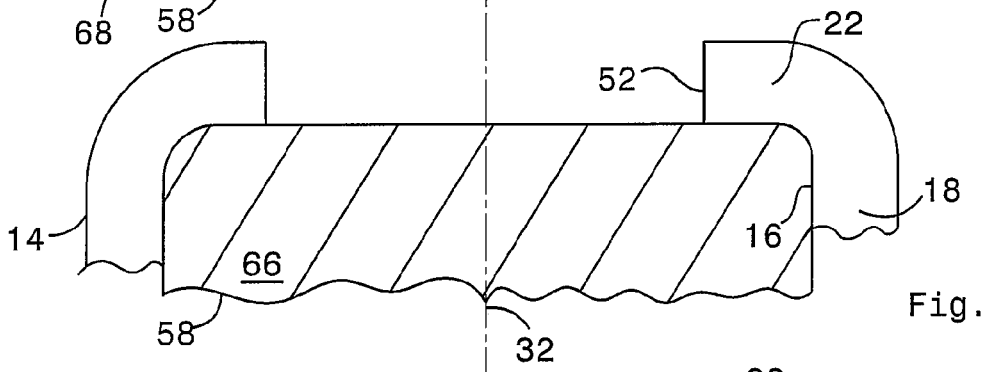
Figure 5D:
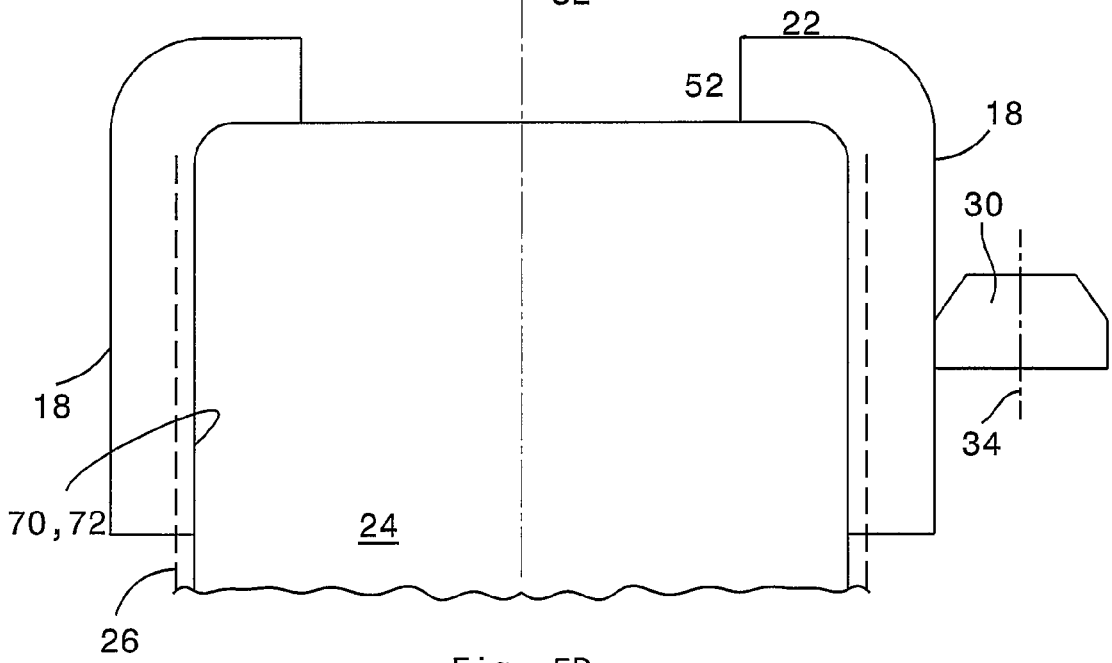

As FIG. 5C shows, as draw ring 70 moves downward along axis 32, the diameter of hole 52 increases, and radial flange 22 is formed with the desired length and the preform plate 50 is forced to conform to the shape of the outer surface 68 of die 58 due to contract pressure between the die and the plate as draw ring 70 is forced over the perform plate.

When plate 50 is formed into the shape of the preform cylinder 14 shown below axis 32 in FIG. 2, die 58 is removed from the preform cylinder and is replaced by mandrel 24. The tailstock 28 is used to clamp flange 22 to the axial end of the mandrel 24. Then rollers 30 are forced into contact with the outer surface 18 of preform 14. Each roller 30 rotates about a respective axis 34 and translates along axis 32.

The outer surface of preform 14 is flow formed by contact pressure between preform cylinder 14 and rollers 30 and by movement of the rollers over the mandrel 24 and the preform. The inner surface of preform cylinder 14 is flow formed due to contact pressure, which forces the preform into contact with the outer surface 68 of mandrel 24. The material of the cylindrical wall of the preform 14 flows axially and radially with respect to axis 32 as the rollers 30 move axially along the axis 32, circumferentially about the axis and radially with respect to the axis.

Preferably, the outer surface 26 of the mandrel 24 is formed with a circular cylinder 71, helical gear teeth 72, such as those that are formed on the inner surface of a ring gear for a planetary gearset of an automatic transmission, or cam ramps 73, such as those that are formed on the inner surface of a one-way clutch race. As flow forming step is performed, the perform 14 attains the shape of cylinder 40, 41 and the inner surface of perform 14 conforms to the shape on the outer surface 68 of mandrel 24. In this way either helical gear teeth 72, cam ramps 73 or a circular cylinder 21 are flow formed on the outer surface 68 of mandrel 24.

Figure 6:
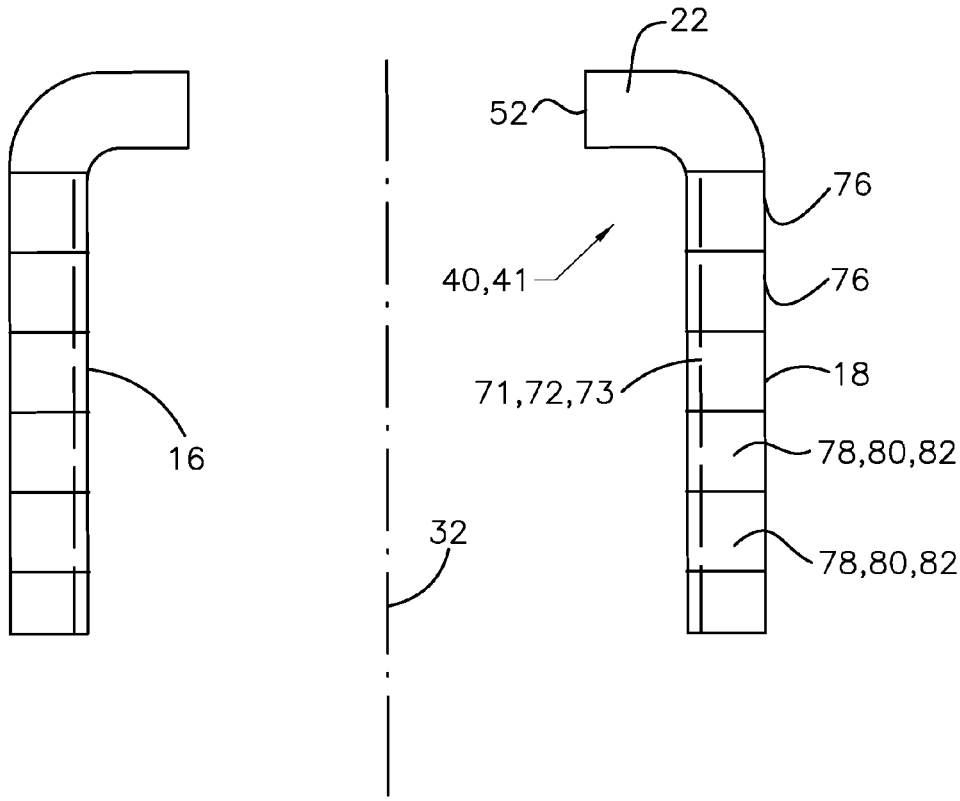
FIG. 6 is a cross section illustrating the ring gear and clutch race of FIGS. 5A-5D before being cut into lengths.

After the flow forming step is executed, the flow formed cylinder 40, 41 will have the shape illustrated in FIG. 6. The internal surface 16 is carburized and induction heated. Next, the outer surface of cylinder 40, 41 is ground to its final shape.

The flow formed cylinder 40, 41 is then cut transversely with respect to axis 32 into multiple segments or ring blanks 76 using either a laser cutting technique or a concentrated jet of pressurized water, as described with reference to FIGS. 3 and 4. The segments 76 will have the form of a right circular cylindrical ring 78, or a ring gear 80 or a race 82 of a one-way clutch, depending on the form of the outer surface 26 of mandrel 24.

Figure 7:
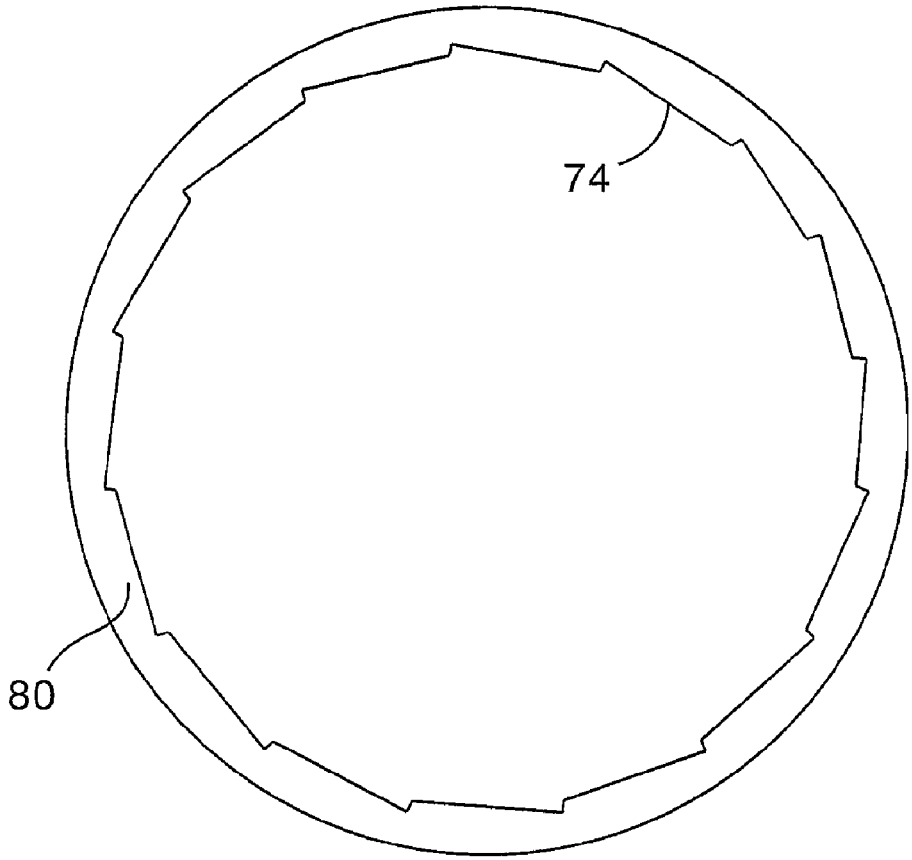
FIG. 7 is a front view of an outer race for a one-way clutch.

FIG. 7 illustrates the race 82 of a one-way clutch that includes ramp cam surfaces 74, formed on the inner surface of the race. The cam surfaces 74 of the race 82 are engaged in service by an engagement element, such as a roller, sprag or ball, to produce a drive connection between an inner race and outer race of the clutch.

Figure 8:
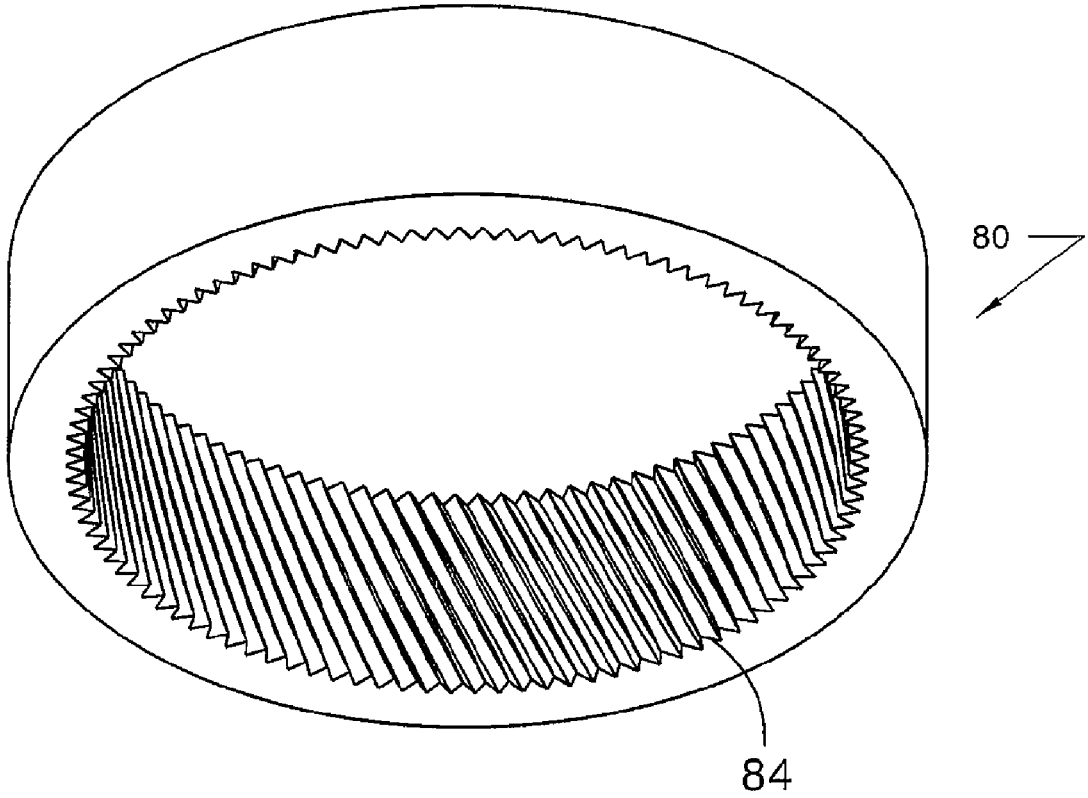
FIG. 8 is a perspective view of a ring gear having internal helical gear teeth.

FIG. 8 illustrates a ring gear 80 for a planetary gearset of an automatic transmission that includes internal helical gear teeth 84, which are cold formed by extruding the gear teeth net-shape in die tooling on the inner surface of the perform cylinder 40, 41.

An alternate method for cold forming a clutch race 90 by extruding the cam surface net-shape in die tooling is described with reference to FIG. 9. The perform cylinder 40, 41 is flow formed and cut into segments 42 having a circular cylindrical inner surface 16 and outer surface 18, as described with reference to FIGS. 1-4 or FIGS. 5A-5D and 6. Preferably, the length of the preform cylinder 40, 41 is sufficient to produce about ten segments 42, from each of which clutch race 90 is to be formed.

Each circular cylindrical segment 42 is spheroidize annealed and coated with a standard phosphate/soap coating, which actions are conventional in metal forming operations.

Figure 9:
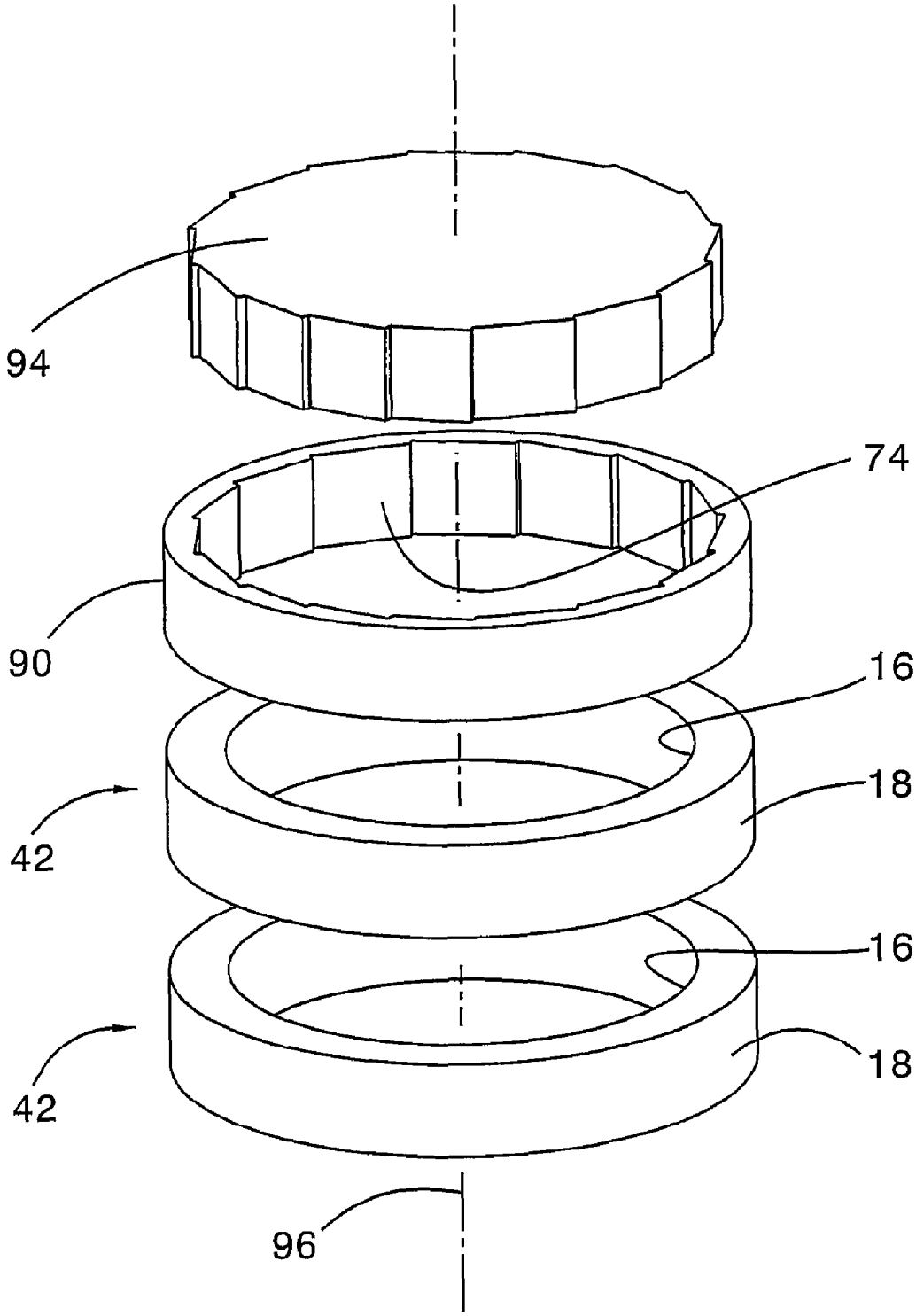
FIG. 9 is a perspective view of a series of segments having been cold formed and cut from a perform cylinder and ready for forming into clutch races.

As FIG. 9 illustrates, a segment 42 is placed in extrusion tooling against a precision ground forming mandrel 94, whose outer surface is formed with the negative of cam surfaces 74 to be formed on the inner surface of the clutch race 90. Standard hydraulic press equipment is used to force mandrel 94 along axis 96 into and through the cylindrical segment to form the cam ramp surfaces 74 on the inner surface 16 of the segment.

After forming the cam ramp surfaces 74 on the inner surface 16 of the segment 42, the outer surface of the segment is ground to within a tight tolerance and the inner surface has a series of cam ramp surfaces 74 arranged angularly about axis 96 and formed to near net shape. The clutch race 90 is thereafter finish machined, thermally processed and coated.

An alternate method for cold forming a ring gear 100 by extruding gear teeth net-shape in die tooling is described with reference to FIG. 10. First, the perform cylinder 40, 41 of FIG. 3 is formed and cut into segments 42 having a circular cylindrical inner surface 16 and outer surface 18, as described with reference to FIGS. 1-4 or FIGS. 5A-5D and 6. Preferably, the length of the preform cylinder 40, 41 is sufficient to produce about ten segments 42, from each of which a ring gear 100 is to be formed.

Each circular cylindrical segment 42 is spheroidize annealed and coated with a standard phosphate/soap coating, which actions are conventional in metal forming operations.

Figure 10:
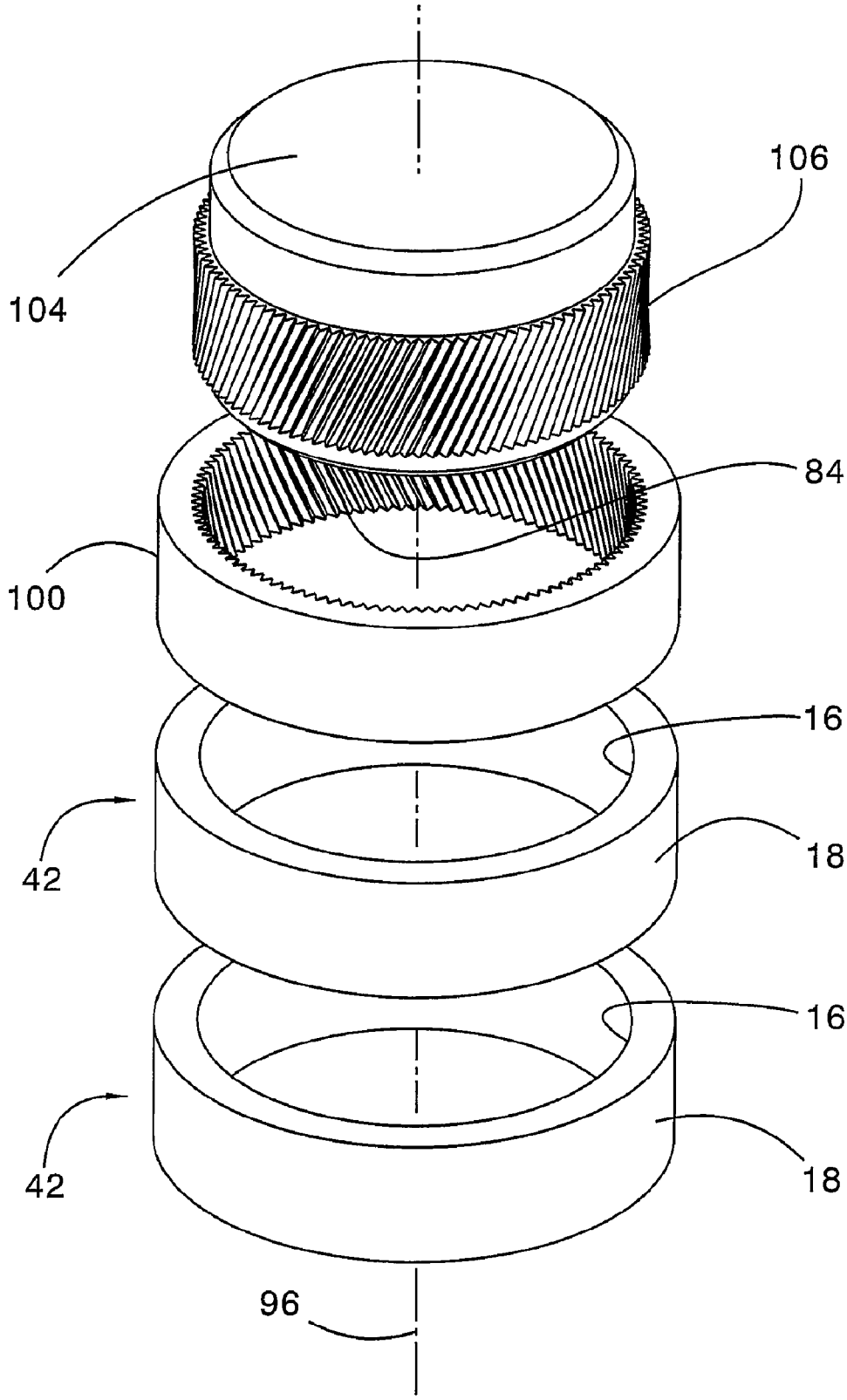
FIG. 10 is a perspective view of a series of segments having been cold formed and cut from a perform cylinder and ready for forming into ring gears.

As FIG. 10 illustrates, a segment 42 is placed in extrusion tooling against a precision ground forming mandrel 104, whose outer surface 106 is formed with the negative of helical gear teeth 84 to be formed on the inner surface of the ring gear 100. Standard hydraulic press equipment is used to force the mandrel 104 along axis 96 into and through the cylindrical segment 42 to form the gear teeth 84 on the inner surface 16 of the segment 42.

After forming the gear teeth 84 on the inner surface of the segment 42, the outer surface 18 of the segment is ground to within a tight tolerance and the inner surface has gear teeth arranged angularly about central axis 96 and formed to near net shape. The ring gear 100 is thereafter finish machined, thermally processed and coated.

In accordance with the provisions of the patent statutes, the preferred embodiment has been described. However, it should be noted that the alternate embodiments can be practiced otherwise than as specifically illustrated and described.

The invention claimed is:

1. A method for forming a component comprising the steps of:

(a) forming a workpiece into a hollow preform cylinder concentric with an axis and including an inner surface and an outer surface that extend along the axis;

(b) placing within the preform cylinder a mandrel having an outer surface;

(c) flow-forming the inner surface and the outer surface of the preform cylinder such that the inner surface of the cylinder conforms to at least a portion of the outer surface of the mandrel;

(d) cutting the cylinder transversely with respect to the axis into segments, each segment having an axial length, the outer surface of the cylinder conforms to a desired shape, and a wall of the cylinder has a desired thickness.

2. The method of claim 1 further comprising:

before forming the workpiece into the hollow perform cylinder, providing a plate with a hole though its thickness and centered on the axis;

forming the plate into the hollow perform cylinder having a flange extending radially with respect to the axis, located at an axial end of the cylinder and surrounding the hole;

securing the preform cylinder on the mandrel by forcing a tailstock against the flange and the mandrel into contact with the flange.

3. The method of claim 1 wherein:

step (a) further comprises the step of cold-forming the preform cylinder having a flange extending radially with respect to the axis, wherein the cold-forming is performed over a die; and the method further comprises securing the preform cylinder on the mandrel by forcing the mandrel into contact with the flange.

4. The method of claim 1 wherein step (b) further comprises the step of placing within the preform cylinder a mandrel having an outer surface formed with one of helical gear teeth, a circular cylindrical surface, a spline, and cam ramp surfaces for a one-way clutch race.

5. The method of claim 1 wherein step (b) further comprises the step of placing within the preform cylinder a mandrel having an outer surface formed with helical gear teeth arranged about the axis and extending along at least a portion of a length of the mandrel.

6. The method of claim 1 wherein step (b) further comprises the step of placing within the preform cylinder a mandrel having an outer surface formed with multiple cam ramps arranged about the axis and extending along at least a portion of a length of the mandrel.

7. A method for forming a component comprising the steps of:

(a) forming a workpiece having a hole substantially concentric with an axis on a die formed with an external surface;

(b) forming the workpiece into a hollow preform cylinder concentric with the axis and including an inner surface and an outer surface that extend along the axis;

(c) removing the die from the preform cylinder and placing therein a mandrel having an outer surface;

(d) forming the inner surface of the preform cylinder such that said inner surface conforms to at least a portion of the outer surface of the mandrel and a thickness of a wall of the preform cylinder; and (e) cutting the formed cylinder transversely with respect to the axis into segments, each segment having an axial length.

8. The method of claim 7 wherein:

step (c) further comprises the step of cold-forming the preform cylinder over a die with a flange extending radially with respect to the axis; and the method further comprises securing the preform cylinder on the mandrel by forcing the mandrel into contact with the flange.

9. The method of claim 7 wherein step (c) further comprises the step of placing within the preform cylinder a mandrel having an outer surface formed with one of helical gear teeth, a circular cylindrical surface, and cam ramp surfaces for a one-way clutch race.

10. The method of claim 7 wherein step (c) further comprises the step of placing within the preform cylinder a mandrel having an outer surface formed with helical gear teeth arranged about the axis and extending along at least a portion of a length of the mandrel.

11. The method of claim 7 wherein step (c) further comprises the step of placing within the preform cylinder a mandrel having an outer surface formed with multiple cam ramps arranged about the axis and extending along at least a portion of a length of the mandrel.

12. The method of claim 7 wherein step (c) further comprises the step of forming the preform cylinder such that the outer surface of the cylinder conforms to a desired shape and a wall of the preform cylinder has a desired thickness.

13. A method for forming a preform component comprising the steps of:

(a) forming a workpiece into a hollow preform cylinder including an inner surface and an outer surface that extend along an axis;

(b) flow-forming the preform cylinder using a first mandrel located with the preform cylinder and having a circular cylindrical outer surface such that the inner surface of the cylinder conforms to at least a portion of said circular cylindrical outer surface and a length of the preform cylinder is a desired length;

(c) cutting the formed cylinder transversely with respect to said length into flow-formed segments, each segment having an axial length; and (d) forcing a second mandrel having an outer surface into and along at least a portion of the segment length such that an inner surface of the segment conforms to at least a portion of the outer surface of the second mandrel.

14. The method of claim 13 wherein step (d) further comprises the step of placing within the formed cylinder the second mandrel having an outer surface formed with one of helical gear teeth and cam ramp surfaces for a one-way clutch race.

15. The method of claim 13 wherein step (d) further comprises the step of placing within the formed cylinder a second mandrel having an outer surface formed with gear teeth extending along at least a portion of a length of the second mandrel.

16. The method of claim 13 wherein step (d) further comprises the step of placing within the formed cylinder a mandrel having an outer surface formed with multiple cam ramps extending along at least a portion of a length of the second mandrel.

17. The method of claim 13 wherein step (b) further comprises the step of forming the preform cylinder such that the outer surface of the cylinder conforms to a desired shape and a wall of the preform cylinder has a desired thickness.

* * * * *